United States Patent [19]

Heng et al.

[11] Patent Number: 5,024,608

[45] Date of Patent: Jun. 18, 1991

[54] CONNECTION DEVICE FOR A COAXIAL CABLE AND A CORRESPONDING CONNECTION MODULE, IN PARTICULAR A JUNCTION BLOCK

[75] Inventors: Jean-Paul Heng, Lyon; André Marmonier, Bron; Henri Guernet, Lyon, all of France

[73] Assignee: Societe Anonyme dite: CEGELEC, Levallois-Perret, France

[21] Appl. No.: 472,542

[22] Filed: Jan. 30, 1990

[30] Foreign Application Priority Data

Jan. 30, 1989 [JP] Japan ..... 8901118

[51] Int. Cl.[5] ..... H01R 9/05

[52] U.S. Cl. ..... 439/578

[58] Field of Search ..... 439/578, 580, 723, 724, 439/675, 584, 585, 579, 582, 583, 482, 836, 837, 835, 912; 174/71 C, 88 C

[56] References Cited

U.S. PATENT DOCUMENTS

| | | | |
|---|---|---|---|
| 2,677,117 | 4/1954 | Swain | 439/482 |
| 2,894,205 | 7/1959 | Schrock et al. | 439/482 |
| 2,914,740 | 11/1951 | Blonder | 174/88 C |
| 4,144,404 | 3/1979 | De Groef et al. | 174/88 C |
| 4,776,812 | 10/1988 | Boissonnet et al. | 439/407 |
| 4,832,439 | 5/1989 | Heng et al. | 350/96.21 |

FOREIGN PATENT DOCUMENTS

| | | |
|---|---|---|
| 1242731 | 6/1967 | Fed. Rep. of Germany . |
| 8714093 | 3/1988 | Fed. Rep. of Germany . |
| 8606125 | 4/1986 | France . |
| 8613610 | 9/1986 | France . |
| 578265 | 7/1976 | Switzerland . |
| 1194994 | 6/1970 | United Kingdom . |

*Primary Examiner*—Joseph H. McGlynn
*Assistant Examiner*—Hien D. Vu
*Attorney, Agent, or Firm*—Sughrue, Mion, Zinn, Mcpeak & Seas

[57] ABSTRACT

The invention relates to a connection device for connecting a coaxial cable (3) and a connection module or for connecting coaxial cables end-to-end, in particular for a junction block. The connection device comprises a link tube (2) having one formed end formed to receive and hold one end of a coaxial cable whose covering is stripped so as to allow electrical contact to be made between the peripheral conductor (4) of the cable and the said formed end. The link tube also contains a fixed link conducting part (10) provided with a connection head (12) for receiving and holding the stripped central conductor of the cable, thereby ensuring electrical continuity between said central conductor and the link conducting part (10). The connection module comprises a link tube having both ends provided with respective connection devices.

9 Claims, 3 Drawing Sheets

CONNECTION DEVICE FOR A COAXIAL CABLE AND A CORRESPONDING CONNECTION MODULE, IN PARTICULAR A JUNCTION BLOCK

The invention relates to connection devices for coaxial cables and to connection modules, in particular of the junction block type, comprising such devices.

It is the practice in industrial installations to connect electric wires or optical fibers either end-to-end or to equipment by means of quick connection devices. The ends of the wires or fibers are inserted into the connection devices without prior preparation or after minimal preparation, and they are held in place and connected by one or a few operations, using little or no tooling.

Such quick connection devices may be incorporated in equipment for connecting wires or fibers to said equipment, or in connection units for electrically or optically interconnecting wires or fibers. Examples of devices of this nature are described, in particular, in the Applicant's applications numbers U.S. Pat. Nos. 4,776,812 and 4,832,439 relating to junction blocks for mounting on standardized support bars for equipment cabinets and frames.

Coaxial cables are usually connected by means of pluggable connectors which are fiddly to install on the cables, and therefore relatively slow and expensive.

In order to remedy these drawbacks, the invention proposes a connection device for the end of a coaxial cable, and a connection module for connecting coaxial cables end to end, in particular a junction block provided with such devices.

The device proposed includes at least one connection device comprising at least one electrically conductive link tube having at least one "connection" end arranged to receive one end of a coaxial cable whose peripheral conductor is stripped of its covering in order to be capable of being electrically connected to the tube into which it penetrates, said tube containing a conducting link part on its axis, which part is fixed to the tube and is electrically insulated therefrom, and is shaped to be capable of axially receiving and holding the stripped end of the central conductor of the cable.

According to a characteristic of the invention, the device includes locking and electrical connection means for the peripheral conductor of a coaxial cable, said means being constituted by resilient peripheral tongues provided at the connection end of the tube and alternating between being splayed apart and being close together depending on the position given to a first ring sliding relative to the tube, and also includes locking and electrical connection means for the central conductor of the above-mentioned cable, said means being constituted by a connection head of the clamping cone type provided with resiliently mounted jaws at the end of the link part, which jaws alternating between being splayed apart and being close together depending on the position given to a second ring sliding on the link part, inside the tube, under the action of a pushbutton projecting outside the tube through a longitudinal opening therein.

The invention, its characteristics, and its advantages are described in greater detail in the following description with reference to the figures listed below.

Figure 1:
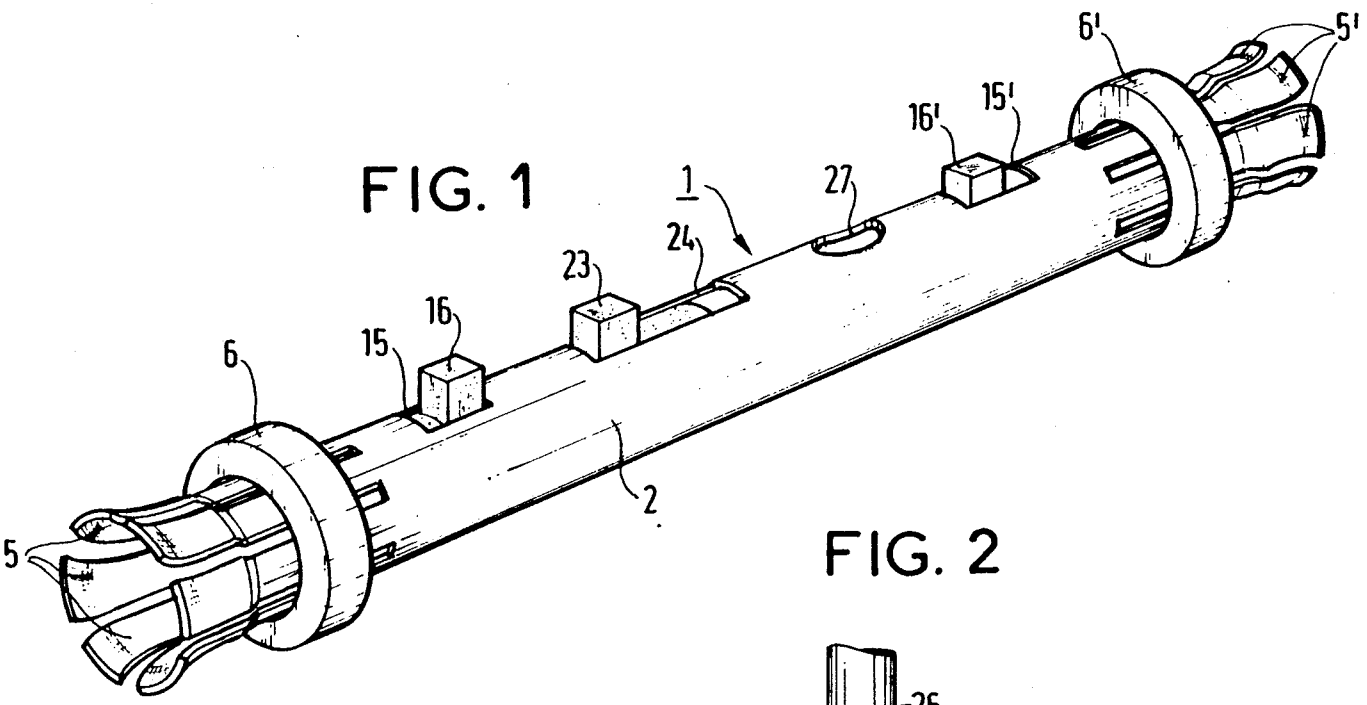
FIG. 1 is a perspective view of a connection module including two devices of the invention.
Figure 2:
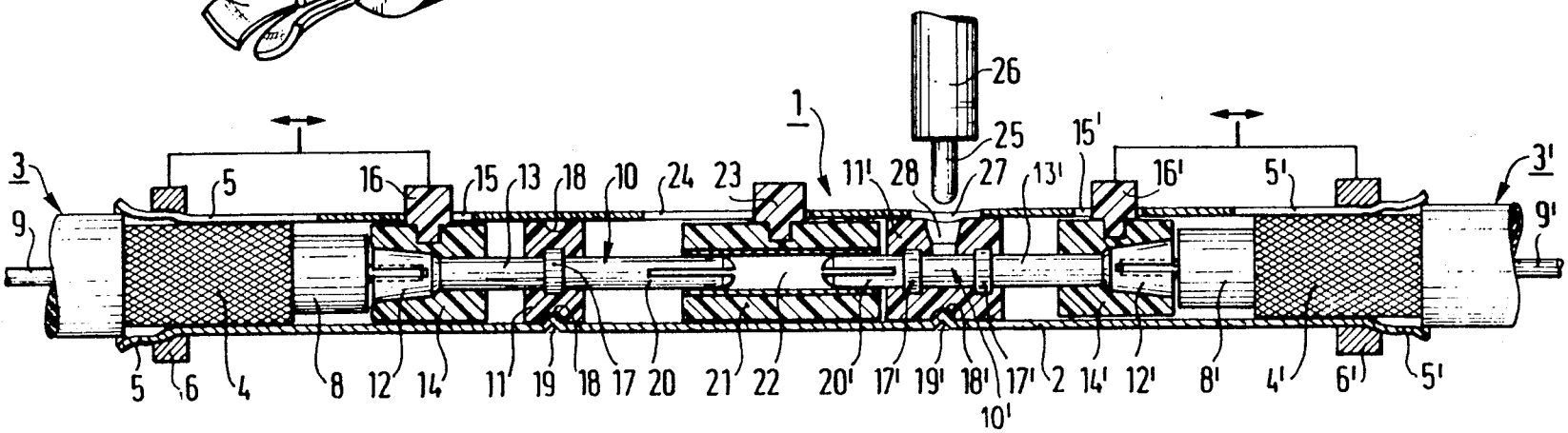
FIG. 2 is a longitudinal section through the connection module shown in FIG. 1.

As mentioned above, FIG. 1 shows a connection module 1 which is tubular in shape and comprises, at each of its two ends, a connection device for connection to one end of a coaxial cable, with the structure of the module and its connection devices being shown in greater detail in FIG. 2.

The connection module 1 is organized relative to a tube 2 made of a conducting material or a material such as a metalized tube which is at least locally conducting, and its ends are shaped in such a manner as to be able to receive and hold the end of a cylindrical object, and in particular a coaxial cable end 3 or 3' which, in this case, is previously stripped of its covering over the peripheral conductor 4 or 4' of the coaxial cable, which peripheral conductor is generally constituted by a cylindrical braid.

In the example shown, the tube 2 is constituted by a single hollow piece with flared ends into which coaxial cables penetrate. Each flared end is provided with open longitudinal slots delimiting longitudinal clamping tongues 5 or 5' therebetween which have a degree of resilience by virtue of their length. By virtue of the shaping of their own free ends, these tongues constitute a flare suitable for facilitating the insertion of a prepared end of a coaxial cable between the tongues into the tube. An outer ring 6 or 6' slides over the tube 2 over each connection device between a first position in which the tongues flare freely, thereby enabling the prepared end of a coaxial cable to be inserted, and a second or clamping position in which the ring comes tight around the clamping tongues 5 and 4'. The cross-section of the opening delimited between the tongues is then reduced, thereby pressing against the prepared end of coaxial cable inserted between the tongues and holding it in place.

In the example shown, the longitudinal clamping tongues 5 or 5' are electrically conductive and they bear against the conductive cylindrical braid which constitutes the peripheral conductor 4 or 4' of the coaxial cable 3 or 3', thereby establishing electrical continuity between said peripheral conductor and the tube 2.

Figure 3:
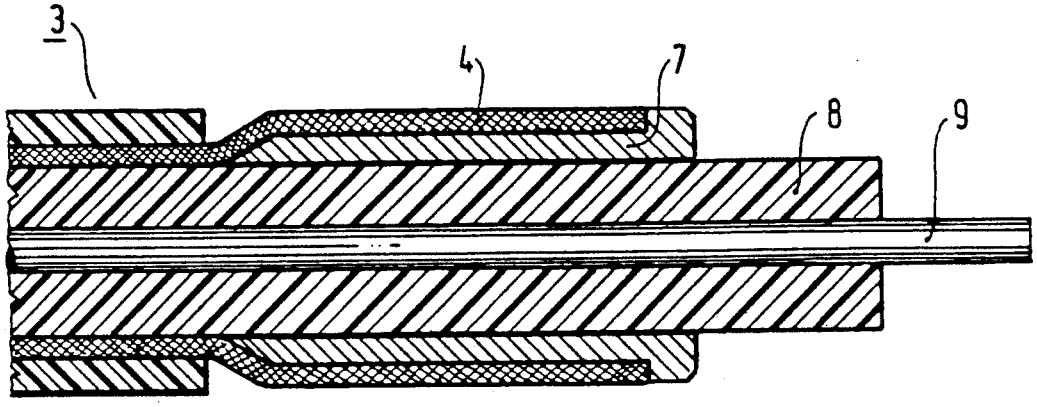
FIG. 3 is a longitudinal section through one end of a coaxial cable provided with an optional auxiliary endpiece to enable it to be connected by means of a device of the invention.

In a variant embodiment shown in FIG. 3, a rigid cylindrical auxiliary endpiece 7 or conducting material is inserted between the cylindrical braid of the peripheral conductor, e.g. 4, at each end of the coaxial cable to be connected and the insulation, e.g. 8, between said peripheral conductor and the central conductor 9 of the cable, said endpiece being located in the zone where the peripheral conductive cylindrical braid is bared.

This makes it easier for the clamping tongues 5 or 5' at an end of the connection device to hold the cylindrical braid in place, with the tongues then pressing the braid against the rigid auxiliary endpiece 7.

A ring 6 or 6' is held in the locking position on the tube 2, in this case, by auxiliary means. This locking may be obtained, for example, by co-operation between complementary projections respectively distributed on the tube 2 and on the ring in question, a tapered outer angular swelling (not shown) on the tube serving, for example, as an anti-return abutment for the ring after the ring has reached its locking position, in a conventional arrangement. The locking may also be obtained so as to take account of the accepted tolerances on the part concerned, the variations in their dimensions over time, in particular as a function of temperature, and as a function of traction that may be applied to the cable, and/or as a function of vibrations transmitted to the tube 2 and/or to the cables, and auxiliary means designed for this purpose are described below with reference to FIG. 5.

The central conductor 9 or 9' of a coaxial cable is connected to a connection device by means of a part 10 or 10' which is held in a fixed position inside the tube 2 by means of a positioning part 11 or 11'.

The conducting part 10 or 10' comprises a head 12 or 12' enabling it to be connected to a central conductor 9 or 9' of a coaxial cable, and in the embodiment shown this central conductor must initially be stripped at its connection end in order to be able to co-operate with a conducting part.

The connection head or cone 12 or 12' of a conducting part is designed in this case to receive a stripped end of the central conductor in a central hollow which is axially positioned inside the tube by the positioning part 11 or 11' which carries the conducting part containing the hollow.

The central hollow is surrounded by the jaws of a clamping cone comprising, for example, a large base into which the chamfered opening of the hollow opens out, thereby enabling the stripped central conductor to be inserted therein. The narrow base of the cone is terminated by a rod 13 or 13' which is cylindrical in this case and which is held in place in the positioning part 11 or 11' of the conducting part to which the cone and the central hollow under consideration belong. Radial slots run along the cone delimiting the jaws which are slightly splayed apart from one another in the rest position, in order to enable a stripped central conductor to be inserted.

A moving internal ring 14 or 14' is associated with each clamping cone in order to move the jaws of the cone towards one another onto one end of a central conductor, thereby holding said end in place inside the conducting part which includes the cone in question. Each internal ring 14 or 14' is suitable for sliding inside the tube 2 which serves to guide it, and it slides simultaneously over a conducting part 10 or 10' level with its cone 12 or 12' which it actuates, and in this case the rod 13 or 13' carrying the cone. To this end, each internal ring 14 or 14' includes a conical axial inside bearing surface which is complementary in shape to the clamping cone onto which it is suitable for coming into position, and in this case it also includes an additional bearing surface enabling it to slide on the rod 13 carrying the clamping cone in question. Each internal ring also includes a cylindrical external bearing surface whereby it bears against and is guided inside the tube 2 as it slides between a rest position where the jaws (which may be three in number) are splayed apart, thereby allowing a central conductor 9 or 9' to penetrate into the central hollow between the jaws, and a clamping position in which the conical bearing surface of the internal ring engages the clamping cone whose teeth tend to move towards one another, thereby reducing the volume of the central hollow and laterally compressing the end of the central conductor 9 or 9' positioned between them inside said central hollow.

An opening 15 or 15', which is generally rectangular in appearance in this case, is provided in the tube 2 over each internal ring 14 in order to enable said ring to be slid along the tube 2 from outside the tube. The means implemented are represented by a button 16 or 16' penetrating from the outside of the tube 9 into a suitable cavity in the internal ring 14 or 14' via the opening 15 or 15'. The dimensions of the cavity are selected to enable the internal ring 14 to be displaced longitudinally between its rest and clamping positions, by acting on the pushbutton 16 or 16', whenever lateral thrust is applied thereto parallel to the axis of the tube 2 by a user.

Figure 5:
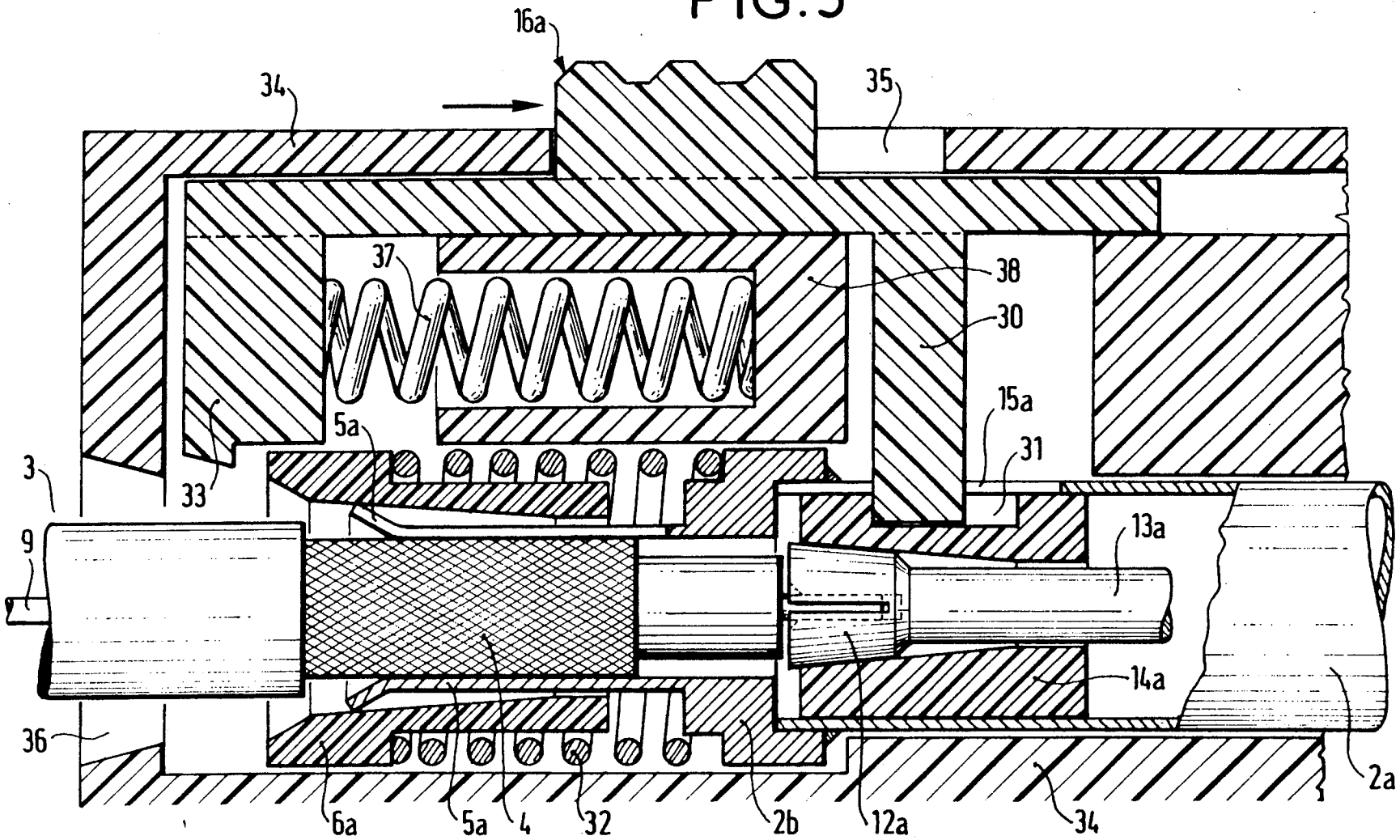
FIG. 5 shows a detail of one embodiment of coaxial cable fixing means in one of the connection devices of the invention in a connection module.

In one embodiment, provision is made for the external ring 6 or 6' and the internal ring 14 or 14' of the same connection device for connection to the same coaxial cable end 9 or 9' to be actuated simultaneously by a single lateral thrust parallel to the axis of the tube 2, as symbolized in FIG. 2 and as shown in FIG. 5 as described below.

The conducting part 10 or 10' is fixed to the positioning part 11 or 11' which may be constituted, for example, by a cylindrical part molded over at least one angular shoulder 17 or 17' provided on the rod 13 or 13' of said conducting part.

The positioning part 11 or 11' is held in a predetermined position inside the tube 2, e.g. by co-operation between an annular groove 18 or 18' formed in its periphery and one or more complementary internal swellings 19 or 19' provided inside the tube 2. The swellings provided for such a disposition enable the two positioning parts 11 and 11' to slide inside the tube 2 when they are themselves inserted, together with other parts not yet described which are housed between the positioning pieces.

The parts 11 and 11' are positioned by inserting the swellings 19 or 19' in the annular grooves 18 or 18', and these positioning parts can then be finally held in place relative to the tube 2 by accentuating the swellings so that they penetrate further into the grooves into which they have entered.

The conducting part 10 may be directly connected to electrical equipment (not shown here) which is also connected to the tube 2, with the positioning part 11 constituting, for example, an extension of an insulating portion of the housing of the equipment mentioned above.

In this case, the tube 2 is provided with a connection device at one end only, its other end receiving the extension constituted by the positioning piece 11 which serves to hold the tube 2 on the equipment housing, with the conducting part 10 then penetrating into the housing through the positioning part.

In the embodiment shown in FIG. 2, the tube 2 is provided with a connection device at each of its two ends, and the positioning parts 11 and 11' are rings threaded inside the tube where they are held in place over the swellings 19 as described above.

In a first embodiment, the two conducting parts 10 and 10' may be combined as a single part having a connection head 12 and 12' at each end.

In a preferred embodiment, the two conducting parts are separate from each other and they are interconnectable by means of a switch.

To this end, each conducting part 10 or 10' has a connection pin 20 or 20'. The connection pin is positioned in this case in alignment with the rod 13 or 13' and it extends the rod from the other side of the shoulder(s) 17 or 17' and to the other end of the part 10 or 10' relative to the connection heads 12 or 12'. The two pins 20 and 20' are in alignment face-to-face on the axis of the tube 2 in a connection unit having two connection devices, and their free ends are separated by an empty gap. A slider 21 made of insulating material in this case is interposed inside the tube 2 between the positioning parts 11 and 11' and it includes a longitudinal duct 22 of such a size as to be capable of plugging over one and/or the other of the two pins 20 and 20'. This longitudinal duct is made in such a manner as to be electrically conductive, e.g. by being metallized, so as to interconnect the pins 20 and 20' when positioned so as to be in contact with both of them.

A pushbutton 23 penetrates into the tube 2 via a longitudinal opening 24 and serves to displace the slider 21 between two positions, and in this case it is received in a ateral cavity in the slider. The lengths of the longitudinal duct 22 and of the pins 20 and 20' are selected in such a manner that the slide 21 interconnects the pins when it is displaced into a first position, and it is in contact with only one of the two pins when it is placed in its other position.

A socket for a test probe is provided on one side of the tube 2, the test probe being assumed to comprise a central conductor 25 which is terminated in the form of a pin, surrounded by a rigid cylindrical conductor 26 which is axially set back relative to the pin-shaped free end of the central conductor.

The tube 2 is provided with a lateral orifice 27 which opens out to one of the positioning parts (in this case the part 17') and it is sized so as to allow a test probe to be inserted in such a manner that the peripheral conductor 26 of the probe is electrically connected to the tube 2.

In the embodiment described, the positioning part 11' is in the form of a cylindrical ring held level with at least one swelling 19' and the orifice 27 of the tube 2. A duct 28 provided laterally in the positioning part 11' enables the central conductor 25 of a test probe to penetrate through the lateral orifice 27 of the tube 2 to reach the conducting part 10', in this case between shoulders 17' which hold the conducting part 10' and its positioning part 11' in position relative to each other.

Two coaxial cables 3 and 3' are interconnected after their ends to be connected have been prepared by stripping their central conductors from one of their ends over a length sufficient to enable each of them to be held in the central hollow of a connection head 12, and obtain adequate electrical connection with said head via the jaws that do the holding, the sufficient length often corresponding to the depth of the central hollow when said hollow is blind.

The peripheral conductor 4 is also stripped of its outer covering, with the covering being removed over a length that corresponds, for example, to the distance between the end of a central hollow in a connection head 12 and the end edge of the tube 2 towards which the hollow faces. The remaining covering then comes into abutment against the end of the tube 2 when the coaxial cable is in place in the connection device.

A prepared end of coaxial cable 3 is connected and held in place by simultaneously displacing the external ring 6 and the internal ring 14 of the connection device in which the end has been inserted, with the displacement thrust being directed laterally parallel to the axis of the tube 2 towards the opening of the device through which the cable penetrates.

In an embodiment, an example of which is shown in FIG. 5, a single pushbutton, referenced **16*a*, serves to displace both the external ring 6*a* and the internal ring 14*a* of a single connection device simultaneously, while allowing the external ring to be displaced further than the internal ring so as to take account of the different characteristics of the clamping means used for the peripheral conductor 4 and for the central conductor 9**.

In the embodiment shown, the tube **2*a* contains the internal ring 14*a* which is driven through an opening 15 in the tube by means of a lug 30 penetrating into the tube via an opening 15*a***.

The lug 30 is received in a longitudinal cavity 31 provided at the periphery of the internal ring beneath the opening, said longitudinal cavity enabling the lug to move in limited longitudinal displacement parallel to the axis of the tube **2*a* prior to entraining the internal ring in translation parallel to the axis of the tube 2*a*** towards the middle of the tube.

The external ring **6*a* is frustoconical on the inside and surrounds the longitudinal clamping tongues 5*a* provided for holding onto and making an electrical connection with a peripheral conductor 4 of a coaxial cable. In this case, the tongues 5*a* are carried by an additional tube 2*b* which is fixed to the end of and which extends one of the cylindrical ends of the tube 2*a***.

The additional tube **2*b* carrying the clamping tongues 5*a* which are functionally identical to the clamping tongues 5 mentioned above serves both as a support and as an abutment for one end of a compression spring 32 whose other end rests on and comes into abutment against the external ring 6*a*. The spring 32 thus tends to urge the external ring outwards relative to the tube 2*a*, and its pressure tends to compress the clamping tongues towards the axis of the tube 2*b* of which they form a part under the action of the frustoconical portion of the external ring 6*a*** which bears against them and which converts the thrust of the spring into compression.

The action of the spring 32 can be overcome by manual action on the pushbutton **16*a* included in a thrust part 33, with the base thereof extending parallel to the lug 30, said thrust part being shaped to push back the external ring 6*a* while compressing the spring, while the pushbutton 16*a* is pressed laterally towards the middle of the tube 2*a*** parallel to the axis of the tube.

The resilience of the longitudinal clamping tongues **5*a* urges them apart from one another, thereby enlarging the insertion inlet for the coaxial cable in the additional tube 2*b* when the external ring 6*a* is displaced by the thrust part in the insertion direction of the coaxial cable, i.e. towards the middle portion of the tube 2*a***.

In this case, the pushbutton **16*a* is slidably mounted inside a housing 34 containing at least the connection device under consideration, and it projects from said housing through a longitudinal opening 35 in such a manner as to be capable of being displaced in translation from a location in which it is possible to insert a prepared end of a coaxial cable to be connected into the tubes 2*a* and 2*b*, when in the connection position, to a location in which the jaws of the connection head 12*a* and the clamping tongues 5*a*** are clamped onto the conductors of a coaxial cable.

To this end, the housing 34 includes a cable insertion orifice 36 in front of which the inlet carrying the clamping tongues **5*a* of a connection device is positioned. The connection device is held in place inside the housing in conventional manner, e.g. by co-operation between its fixed portions including the tubes 2*a*** and complementary projections provided on the inside of the housing, which housing may be found of molded insulating material, for example.

The pushbutton 16*a* is returned to the position where it clamps onto the coaxial cable by means of a helical compression spring 37 which bears, in this case, firstly against a fixed wall 38 of a recess provided therefor in the housing 34, and secondly against the thrust part 33 so as to move the thrust part away from the ring 6*a* in the absence of manual opening thrust exerted on the pushbutton 16*a* towards the middle of the link tube 2*a* parallel to the axis of said tube.

In order to insert a prepared coaxial cable end into a connection device in accordance with this embodiment, the pushbutton 16*a* must be pushed back in the coaxial cable insertion direction, after which the central conductor 9 should be inserted into the central hollow of the connection head 12*a*, and the peripheral conductor 4 should be inserted in the duct existing between the clamping tongues 5*a*.

On being released, the pushbutton 16*a* is displaced towards the end of the housing at which it is situated under the effect of the spring 37 acting on the thrust part 33. The external ring 6*a* pushed back by its helical spring 32 follows the displacement of the pushbutton 16*a* and imprisons the peripheral conductor 4 between the clamping tongues 5*a*, thereby simultaneously connecting said peripheral conductor to the tubes 2*a* and 2*b*.

After a short wait due to the shape of the cavity 31, the 30 pushbutton 16*a* entrains the internal ring 14*a* which clamps the central conductor 9 between the jaws of the connection head 12*a*, thereby establishing electrical continuity between said central conductor and the conducting part 10 as a whole which includes said head.

The spring 32, the external ring 6*a*, and the clamping tongues 5*a* of the additional tube 2*a* are shaped so as to hold the central conductor 9 of the coaxial cable stationary in spite of vibration and/or dimensional changes that may occur due either to the parts in question or to the climatic environment.

Figure 4:
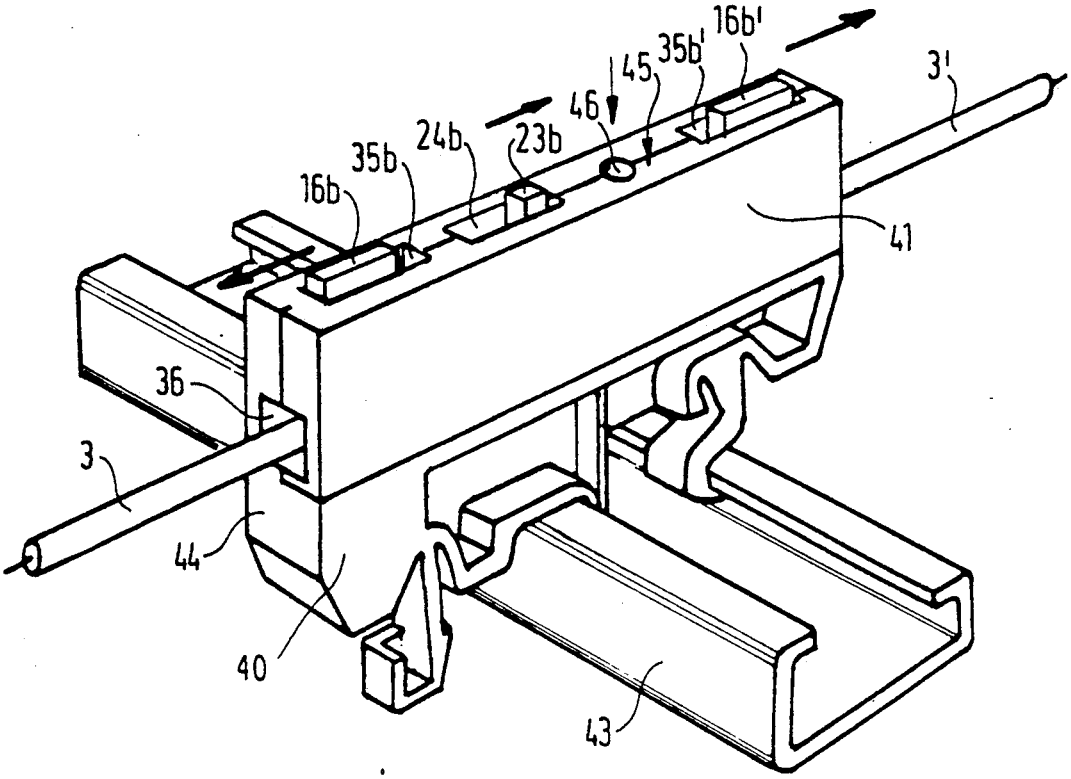
FIG. 4 is a perspective view of a connection module of the junction block type mounted on a support bar.

The connection device of the invention and/or the connection module comprising two such devices back-to-back can be incorporated in numerous types of equipment, and in particular, the module may be used to constitute a junction block such as that shown in FIG. 4.

The junction block is provided in this case in a body of molded insulating material comprising two complementary portions 40 and 41. The portion 40 includes legs enabling the junction block to be fixed on various standardized support bars, with one version 43 being shown having inwardly directed parallel rims at different offsets.

The legs included in the portion 40 are of the same type as described in the present Applicants' French patent application number 2 392 576.

The portion 41 of the body is in the form of a plate which is rectangular in appearance and which serves to close an opening of complementary shape in the portion 40 on which the portion 41 is fixed, e.g. by snap-fastening and/or ultrasonic welding.

In this case, the opening is provided to one side above the legs on one of the large faces of the generally rectangular body, and it enables connection members including the tube to be inserted into the housing formed by the block.

The, or each, tube 2 is disposed longitudinally in the block in such a manner that the cable insertion orifices such as 36 open out through the end facettes of the block such as 44.

The pushbuttons 16*b* and 16*b'* for displacing the internal and external rings correspond at least in function to the pushbutton 16*a* described with reference to FIG. 5, and they project through the top face 45 of the block away from its legs and through longitudinal openings 35*b* and 35*b'* corresponding to the longitudinal openings 35 of FIG. 5.

A pushbutton 23*b* which projects through a longitudinal opening 24*b* in the top face 45 serves to displace a switching slider corresponding to the slider 21 of FIG. 1.

An orifice 46, provided in this case between the longitudinal openings 24*b* and 35*b*, is provided to enable a test probe to be inserted into a socket enabling the conductor of the probe to be put into contact with a central conducting part of the connection unit and to enable the peripheral conductor of the probe to be put into contact with the link tube, in an arrangement corresponding, in function, to that described with reference to FIG. 2.

We claim:

1. A connection device comprising at least one electrically conductive link tube (2) having at least one "connection" end arranged to receive one end of a coaxial cable (3) whose peripheral conductor (4) is stripped of its covering in order to be capable of being electrically connected to the tube into which it penetrates, said tube containing a conducting link part (10) on its axis, which part is fixed to the tube and is electrically insulated therefrom, and is shaped to be capable of axially receiving and holding the stripped end of the central conductor (9) of the cable, the said device being characterized in that it includes locking and electrical connection means for the peripheral conductor of a coaxial cable, said means being constituted by resilient peripheral tongues (5) provided at the connection end of the tube and alternating between being splayed apart and being close together depending on the position given to a first ring (6) sliding relative to the tube, and also includes locking and electrical connection means for the central conductor of the above-mentioned cable, said means being constituted by a connection head (12) of the clamping cone type provided with resiliently mounted jaws at the end of the link part, which jaws alternating between being splayed apart and being close together depending on the position given to a second ring (14) sliding on the link part, inside the tube, under the action of a pushbutton (16) projecting outside the tube through a longitudinal opening (15) therein.

2. A connection device according to claim 1, characterized in that the connection head of a conducting part is mounted at the end of a rod (13) on which the second ring slides, said rod being fixed inside a positioning part (11) held stationary inside the tube at a predetermined position behind the connection head relative to the connection end of the tube towards which said head opens in order to receive a cable's central conductor.

3. A connection device according to claim 1, characterized in that the first ring, at least, is pushed back into a position for holding and making electrical contact with a conductor of the cable by means of a helical spring (32) which is centered on the longitudinal axis common to the tube and to said first ring, and which bears against the tube for this purpose.

4. A connection device according to claim 1, characterized in that it includes a single pushbutton (16*a*) movable parallel to the axis of the tube for displacing both of the rings at a connection end of the tube, said rings comprising a ring internal to the tube and a ring external to the tube, said rings being displaced between a first position for insertion of a central conductor and a peripheral conductor of the same cable, respectively between the jaws of the connection head and between the tongues of the connection end under consideration, and a second position in which both conductors are held in place and make electrical conduct, one of them with the tube and the other with the link part.

5. A connection device according to claim 4, characterized in that it includes a pushbutton (16*a*) received inside a housing (34), the pushbutton being displaceable from outside the housing via a longitudinal window extending parallel to the axis of the tube and having a drive lug (30) for driving the second ring (14*a*) and penetrating into a longitudinal cavity formed in the periphery of said ring, thereby enabling said drive lug to have a limited degree of longitudinal lost motion, the pushbutton also having a thrust part (33) for driving the first ring (6*a*) and suitable for thrusting said first ring into an unclamping position against the urging of the central spring.

6. A module for interconnecting coaxial cables end to end, and in particular a junction block, characterized in that it comprises two connection devices according to claim 1, formed at respective ends of a single link tube (2).

7. A connection module according to claim 6, characterized in that it includes a socket (27, 28) for a test probe, the socket being provided through the tube over one of the positioning parts of the conducting part in order to enable electrical contacts to be established firstly between the tube and the peripheral conductor (26) of the probe, and secondly between the conducting part in question and the central conductor (35) of said probe.

8. A connection module according to claim 6, characterized in that it includes a switch (51) received inside the tube between the two links parts (10, 10') of the connection devices provided at the ends of the tube, said switch being operable from outside said tube, and being suitable for alternatively establishing an electrical connection between the two link parts or for interrupting the connection.

9. A connection module according to claim 8, characterized in that the switch is constituted by a slider (21) received inside the tube between the two conducting parts, each of which comprises a pin (20, 20') lying on the axis of the tube and facing the other pin, the slider having a longitudinal duct (22) which is electrically conducting, enabling the slider to be engaged over one and/or the other of the pins and alternating between establishing or not establishing electrical connections therebetween as a function of the position imposed on the slider from outside the tube by a pushbutton (23) which is movable in translation along a longitudinal opening block(24) through the tube.

* * * * *